US006698255B1

(12) United States Patent
Dorstewitz

(10) Patent No.: US 6,698,255 B1
(45) Date of Patent: Mar. 2, 2004

(54) ROTATION HOOP KNIFE SPLITTING MACHINE

(76) Inventor: Rainer Dorstewitz, Alter Weg 5, 64625 Bensheim (DE)

( * ) Notice: Subject to any disclaimer, the term of this patent is extended or adjusted under 35 U.S.C. 154(b) by 0 days.

(21) Appl. No.: 10/317,499

(22) Filed: Dec. 12, 2002

(51) Int. Cl.[7] ..... C14B 1/14
(52) U.S. Cl. ..... 69/9; 69/1
(58) Field of Search ..... 69/1, 2, 9, 9.5, 69/10, 11, 13, 15, 16, 19.1, 21.5

(56) References Cited

U.S. PATENT DOCUMENTS

| | | | | |
|---|---|---|---|---|
| 1,012,107 A | * | 12/1911 | Shockley | 69/9 |
| 1,090,799 A | * | 3/1914 | Spigno | 69/9 |
| 2,214,461 A | * | 9/1940 | Hendry | 69/1 |
| 2,884,777 A | * | 5/1959 | Kremen | 69/1 |
| 3,393,538 A | | 7/1968 | Mercier | |
| 4,901,542 A | | 2/1990 | Gidge et al. | |

FOREIGN PATENT DOCUMENTS

| | | |
|---|---|---|
| DE | 197 14 592 A1 | 10/1998 |
| FR | 579565 | 10/1924 |
| FR | 894889 | 12/1944 |
| FR | 2471412 | 6/1981 |
| FR | 2549409 | 1/1985 |
| GB | 1010797 | 11/1965 |

* cited by examiner

*Primary Examiner*—Gary L. Welch
(74) *Attorney, Agent, or Firm*—Friedrich Kueffner

(57) ABSTRACT

A rotary hoop knife splitting machine, particularly for splitting skin free from hair, includes a knife with a cutting edge, a feeding device arranged in front of the cutting edge, wherein the feeding device includes a transport gap defined by a base and a driven transport roll, and a feeding gap defined by another base and a driven feeding roll. The transport gap and the feeding gap are arranged closely one behind the other. The transport roll has a diameter which increases from the middle toward the ends. The transport roll is composed of two parts connected to each other in an articulated manner so as to rotate together. The two parts are mounted such that a surface line of the transport roll at the transport gap is a straight line extending parallel to the base.

10 Claims, 3 Drawing Sheets

ROTATION HOOP KNIFE SPLITTING MACHINE

BACKGROUND OF THE INVENTION

1. Field of the Invention

The present invention relates to a rotation hoop knife splitting machine, particularly for splitting skin which is free from hair. The machine includes a feeding device arranged in front of the cutting edge of the knife, wherein a transport gap defined by a base and a driven transport roll and a feeding gap defined by a base and a driven feeding roll are arranged closely one behind the other.

2. Description of the Related Art

A rotation hoop knife splitting machine of the above-described type is disclosed in DE 197 14 592 A1. The transport roll as well as the feeding roll are cylindrically shaped and interact with a plane base which, in the described embodiment, is stationary. The separation of the transport function from the feeding function makes it possible to carry out very accurate splitting, even in the case of material which is difficult to split, such as skin which is free from hair.

SUMMARY OF THE INVENTION

It is the primary object of the present invention to facilitate feeding of the material to be split and to further improve the splitting accuracy.

In accordance with the present invention, the transport roll has a diameter which increases toward the ends of the transport roll, wherein the transport roll is composed of at least two parts which are connected to each other in an articulated manner so as to rotate together, and wherein the two parts of the transport roll are mounted in such a way that the surface line of the transport roll at the transport gap is a straight line extending parallel to the base.

The configuration according to the present invention results in transport speeds of the transport roll which increase from the center toward the outside. This provides the following advantage: conventionally, a skin, for example, cowhide leather, is cut at the belly line and is placed in the correct plane for travel through the rotation hoop knife splitting machine. The belly area has a larger surface and a looser structure than the back area. If such a skin is moved by means of a cylindrical transport roll, the belly area is held up during the transport of the skin, while the middle portion along the back line essentially travels ahead of the belly area. This can be compensated by strongly decelerating the skin in the middle portion thereof either manually or by means of a braking device. However, if the transport roll according to the present invention is used, the conicicity of the roll results in higher circumferential speeds at the outer areas. Since no slippage or only little slippage occur in the transport gap, the skin is inevitably transported in the end areas at a higher speed than the rest of the skin and, consequently, the skin is stretched transversely of the transport direction. As a result, the belly area is essentially not held up and very accurate splitting is possible.

In accordance with an advantageous feature, the transport roll is composed of two cone-shaped parts. This means that the transport roll is of simple construction with only one coupling in the middle of the transport roll.

In accordance with another advantageous feature, two outer bearings and a middle support bearing are provided for the transport roll. The support bearing makes it possible in a simple manner to maintain in the support gap the desired straight surface line of the transport roll.

Preferably, the change of the diameter of the transport roll from the center to the outer ends is at least 5%. The best results are obtained if the increase is 15% or more. In accordance with an example, the transport roll has a diameter of 76 mm in the middle and a diameter of 90 mm at the ends.

In accordance with a recommended feature, the parts of the transport roll are connected to each other through a curved teeth connection, as it is known to be used in a curved teeth coupling. However, other conventional articulated couplings are also conceivable.

It is advantageous if, in the area of the transport roll having the greatest diameter, the circumferential speed of the feeding roll is at least equal to the circumferential speed of the transport roll. This ensures that the material which is transported at a greater speed in the area of the belly is moved toward the cutting edge of the knife in such a way that the skin is not held back and a more uniform cut can be achieved.

It is also advantageous if the transport roll is constructed as a rotary stretcher. This results in an increased stretching of the material to be split transversely of the conveying direction.

In accordance with an advantageous feature, the base of the transport gap includes an endless belt which is guided around a bottom roll which can be biased by means of a contact pressure device in the direction toward the transport roll. Such a feeding device with a moveable base is always recommended over a stationary base if the material to be split for histological reasons and reasons of body shape poses similar problems during cutting as a limed skin material, but that does not have the sliding properties of the latter.

In particular, the bottom roll may be supported by levers, wherein the contact pressure device in the form of a piston-cylinder unit acts on the levers. This results in a simple construction.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
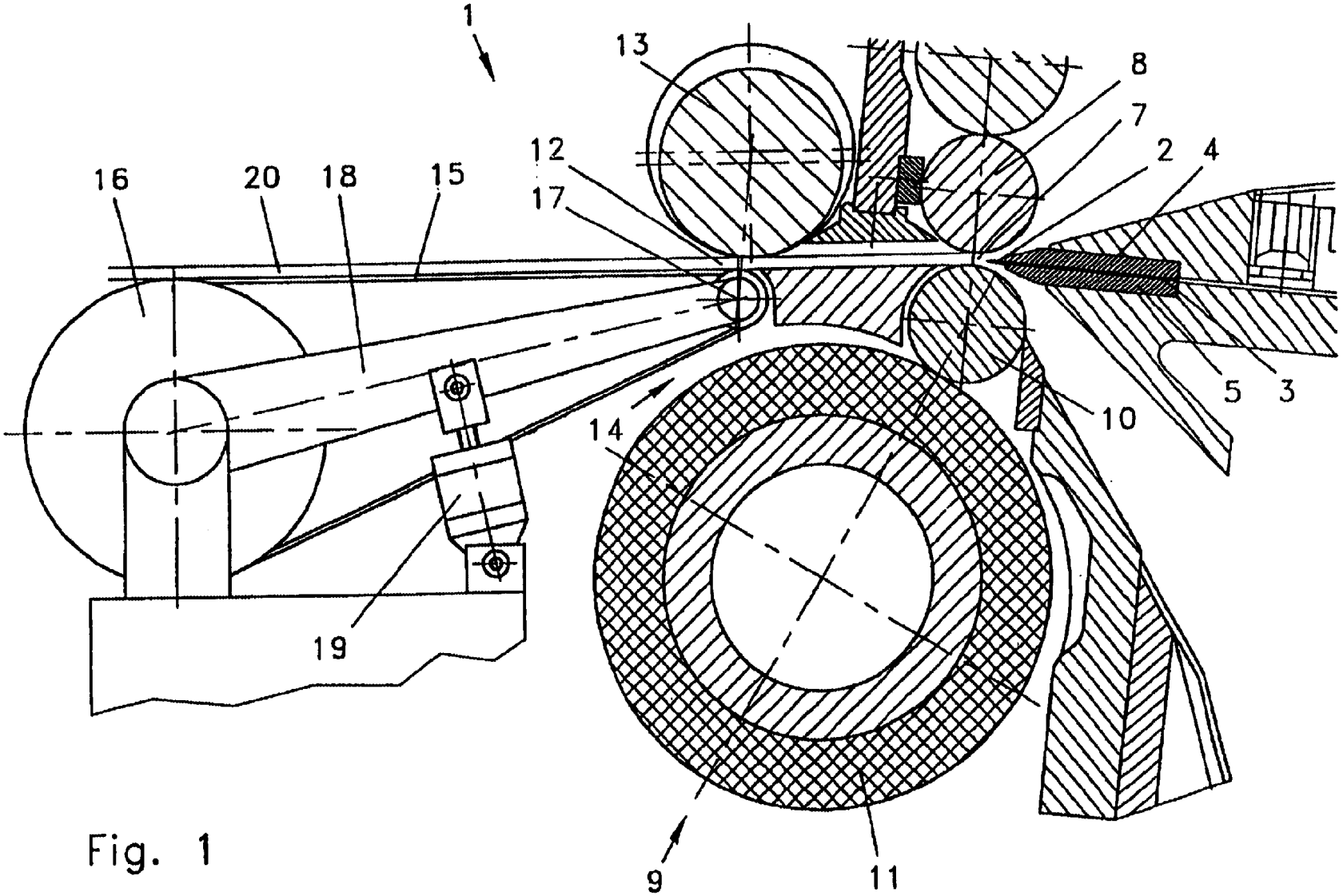
FIG. 1 is a sectional view of the work area of a rotary hoop knife cutting machine in accordance with the present invention.
Figure 3:
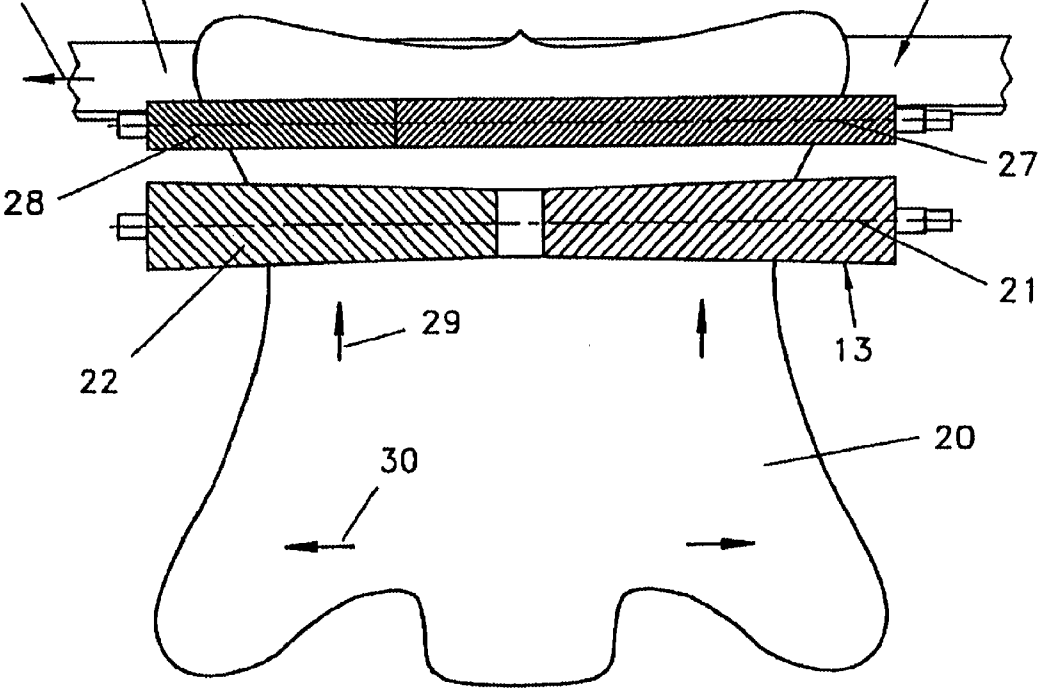
FIG. 3 is a schematic top view of the transport roll and the feeding roll of the machine and FIG. 4 shows a curved teeth coupling of the two parts of the transport roll.

The rotary hoop knife splitting machine 1 illustrated in FIG. 1 includes a knife 3 provided with a cutting edge 2, wherein the knife 3 rotates between two fittings 4 and 5 perpendicularly of the plane of the drawing in the direction of arrow 6, shown in FIG. 3.

A feeding gap 7 is arranged in front of the cutting edge 2. The feeding gap 7 is defined at the top by a driven feeding or master roll and at the bottom by an elastic base 9 which, in the illustrated embodiment, is composed of an articulated roll 10 and an elastic roll 11. The knife 3 is arranged immediately at the outlet of the feeding gap 7. A transport gap 12 is arranged immediately in front of the feeding gap 7. The transport gap 12 is defined at the top by a driven transport roll 13 and at the bottom by an elastic base 14. The base 14 includes a transport belt 15, a fixedly mounted roll 16 and a bottom roll 17 which is attached to a cantilever 18 and is located opposite the transport roll 13. The cantilever 18 can be pressed against the transport roll 13 by means of a contact pressure device 19 which, in the illustrated embodiment, is a piston-cylinder unit. Instead of the illustrated rotating base 14 for the transport gap 12, it is also possible to use a non-rotating plane base, as it is known from DE 197 14 592 A1. The same is also true for the revolving base 9 at the feeding gap. Material to be split 20, particularly skin free from hair, is moved through the transport gap 12 and the feeding gap 7 toward the cutting edge 2.

Figure 2:
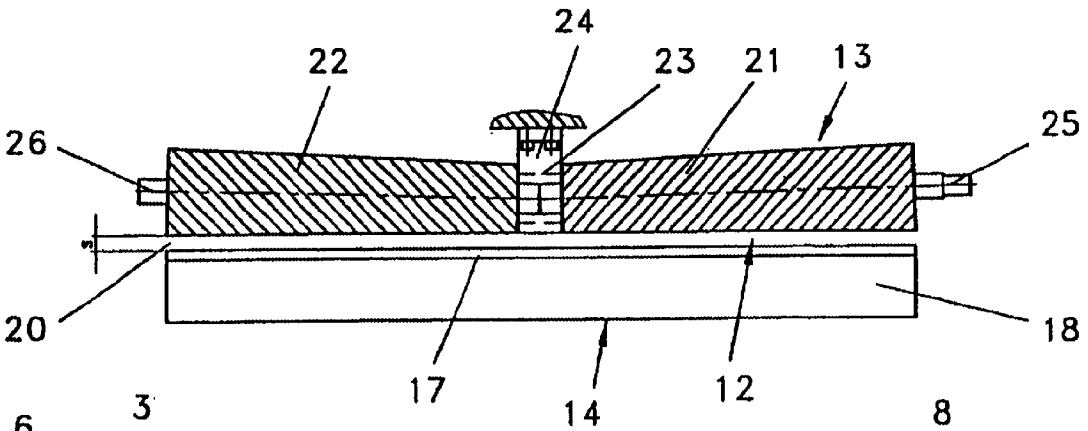
FIG. 2 is a transverse sectional view of the transport gap of the machine.
Figure 4:
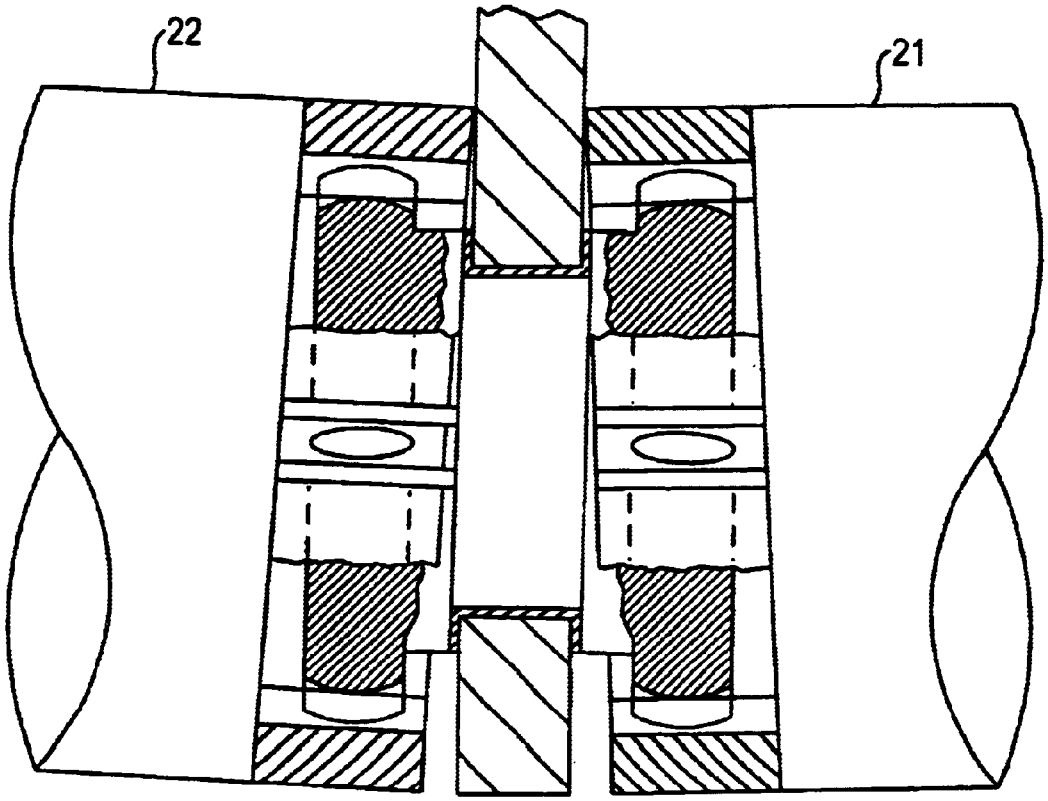

As illustrated in FIG. 2, the transport roll 13 is composed of two parts 21 and 22. The two parts are connected in the middle by means of an articulated coupling 23, for example, a curved teeth coupling shown in FIG. 4, and are supported in a support bearing 24. The drive is effected through an outer bearing 25 of the first part 21. The second part 22 is supported in an outer bearing 26. Both parts 21 and 22 are conically shaped, wherein the diameter increased from the middle toward the ends. The change of the diameter should be at least 5%, but could also be 10%, 15% or more. The two parts 21 and 22 are supported by the support bearing in such a way that the surface line facing the base 14 forms a straight line. The two parts 21 and 22 have oppositely directed ribbings in order to improve the contact with the material 20 and also to achieve a stretching effect in the transverse direction. Oppositely directed ribbings 27 and 28 on the surface of the feeding roll 8 are conventional.

When a skin free from hair is supplied as the material to be split 20, the conical shape of the transport roll 13 at the edges of the material 20 results in an increased transport speed as compared to the middle. Consequently, the softer belly portions are transported toward the feeding gaps 7 ahead of the middle back portion. Taking place simultaneously with the forward movement as indicated by arrow 29 is a stretching effect in the transverse direction as indicated by arrow 30, which is partially due to the different circumferential speeds and partially to the oppositely directed ribbings of the transport roll 13 and, if applicable, of the feeding roll 8.

In accordance with a preferred feature, it is ensured that the circumferential speed of the feeding roll 8 is at least equal to the circumferential speed of the transport roll 13 in the area of the greatest diameter thereof. Consequently, the belly portions which travel ahead are securely received in the feeding gap and are then cut with high accuracy by the knife.

While specific embodiments of the invention have been shown and described in detail to illustrate the inventive principles, it will be understood that the invention may be embodied otherwise without departing from such principles.

I claim:

1. A rotary hoop knife splitting machine, particularly for splitting skin free from hair, the machine comprising a knife with a cutting edge, a feeding device arranged in front of the cutting edge, wherein the feeding device includes a transport gap defined by a base and a driven transport roll, and a feeding gap defined by another base and a driven feeding roll, wherein the transport gap and the feeding gap are arranged closely one behind the other, wherein the transport roll has a middle and ends, the transport roll having a diameter which increases from the middle toward the ends, and wherein the transport roll is comprised of two parts connected to each other in an articulated manner so as to rotate together, and wherein the two parts are mounted such that a surface line of the transport roll at the transport gap is a straight line extending parallel to the base.

2. The rotary hoop knife splitting machine according to claim 1, wherein the two parts of the transport roll are conically shaped.

3. The rotary hoop knife splitting machine according to claim 2, comprising a middle support bearing at the middle of the transport roll and two outer bearings at the ends of the transport roll.

4. The rotary hoop knife splitting machine according to claim 1, wherein the diameter of the transport roll increases from the middle toward the ends by at least 5%.

5. The rotary hoop knife splitting machine according to claim 1, comprising a curved teeth connection connecting the two parts of the transport roll.

6. The rotary hoop knife splitting machine according to claim 1, wherein the feeding roll and the transport roll are dimensioned such that, at an area of the greatest diameter of the transport roll, the circumferential speed of the feeding roll is at least equal to the circumferential speed of the transport roll.

7. The rotary hoop knife splitting machine according to claim 1, wherein the transport roll is a rotary stretcher.

8. A rotary hoop knife splitting machine, particularly for splitting skin free from hair, the machine comprising a knife with a cutting edge, a feeding device arranged in front of the cutting edge, wherein the feeding device includes a transport gap defined by a base and a driven transport roll, and a feeding gap defined by another base and a driven feeding roll, wherein the transport gap and the feeding gap are arranged closely one behind the other, wherein the transport roll has a middle and ends, the transport roll having a diameter which increases from the middle toward the ends, and wherein the transport roll is comprised of two parts connected to each other in an articulated manner so as to rotate together, and wherein the two parts are mounted such that a surface line of the transport roll at the transport gap is a straight line extending parallel to the base, wherein the base of the transport gap comprises an endless belt guided around a bottom roll, further comprising a contact pressure device for biasing the bottom roll toward the transport roll.

9. The rotary hoop knife splitting machine according to claim 8, further comprising levers supporting the bottom roll, wherein the contact pressure device is comprised of a piston-cylinder unit configured to act on the levers.

10. A rotary hoop knife splitting machine, particularly for splitting skin free from hair, the machine comprising a knife with a cutting edge, a feeding device arranged in front of the cutting edge, wherein the feeding device includes a transport gap defined by a base and a driven transport roll, and a feeding gap defined by another base and a driven feeding roll, wherein the transport gap and the feeding gap are arranged closely one behind the other and the knife is arranged at an outlet of the feeding gap, wherein the transport roll has a middle and ends, the transport roll having a diameter which increases from the middle toward the ends, and wherein the transport roll is comprised of two parts connected to each other in an articulated manner so as to rotate together, and wherein the two parts are mounted such that a surface line of the transport roll at the transport gap is a straight line extending parallel to the base.

* * * * *